US009806402B2

(12) United States Patent
Liu et al.

(10) Patent No.: US 9,806,402 B2
(45) Date of Patent: Oct. 31, 2017

(54) ANTENNA MODULE

(71) Applicants: Shijie Liu, Shenzhen (CN); Yongli Chen, Shenzhen (CN); Xing Yuan, Shenzhen (CN); Xiaopu Wu, Shenzhen (CN)

(72) Inventors: Shijie Liu, Shenzhen (CN); Yongli Chen, Shenzhen (CN); Xing Yuan, Shenzhen (CN); Xiaopu Wu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 111 days.

(21) Appl. No.: 14/832,895

(22) Filed: Aug. 21, 2015

(65) Prior Publication Data

US 2016/0211572 A1 Jul. 21, 2016

(30) Foreign Application Priority Data

Jan. 20, 2015 (CN) ..... 2015 2 0040079 U

(51) Int. Cl.
*H01Q 1/24* (2006.01)
*H01Q 9/42* (2006.01)

(52) U.S. Cl.
CPC ..... *H01Q 1/243* (2013.01); *H01Q 9/42* (2013.01)

(58) Field of Classification Search
None
See application file for complete search history.

(56) References Cited

U.S. PATENT DOCUMENTS 8,890,754 B2 * 11/2014 Lin ..... H01Q 5/335 343/700 MS
2013/0127674 A1 * 5/2013 Korva ..... H01Q 1/243 343/702
2013/0203364 A1 * 8/2013 Darnell ..... H01Q 1/243 455/77
2013/0299785 A1 * 11/2013 Kim ..... H01L 51/5268 257/40
2014/0347226 A1 * 11/2014 Iellici ..... H01Q 1/243 343/702
2014/0347227 A1 * 11/2014 Iellici ..... H01Q 1/243 343/702
2014/0361948 A1 * 12/2014 Tanaka ..... H01Q 1/38 343/861
2015/0340757 A1 * 11/2015 Rho ..... H01Q 1/46 343/702
2016/0064801 A1 * 3/2016 Han ..... H01Q 1/243 343/702

* cited by examiner

*Primary Examiner* — Trinh Dinh
(74) *Attorney, Agent, or Firm* — Na Xu; IPro, PLLC

(57) ABSTRACT

An antenna module for a mobile communication device is provided in the present disclosure. The antenna module includes a main board, a feed point and at least one ground point provided on the main board, a metal radiator opposite to the main board and electrically connected with the at least one ground point of the main board and a capacitive coupling feed part attached to a surface of the metal radiator and facing the main board, the capacitive coupling feed part being electrically connected to the feed point of the main board via a connecting member.

17 Claims, 2 Drawing Sheets

ANTENNA MODULE

FIELD OF THE DISCLOSURE

The present disclosure generally relates to mobile communication technologies, and more particularly, to an antenna module applicable to a mobile communication device.

BACKGROUND

With the development of mobile communication technologies, mobile communication devices such as mobile phones, tablet computers, or the like, are used widely. Mobile communication devices with metal shells are preferred by people because of their fashion appearance as well as good durability.

However, a metal shell may bring an electromagnetic shielding effect against an antenna module of the mobile communication device and decrease a radiation performance of the antenna module. In order to improve a radiation space of the antenna module, in a related mobile communication device, an antenna module is designed to feeds to a metal frame or a metal back cover of the mobile communication device directly. Nevertheless, the foregoing antenna module still has some deficiencies such as narrow bandwidth and low radiation efficiency.

Therefore, it is necessary to provide a new antenna module which can overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and an embodiment thereof.

Figure 1:
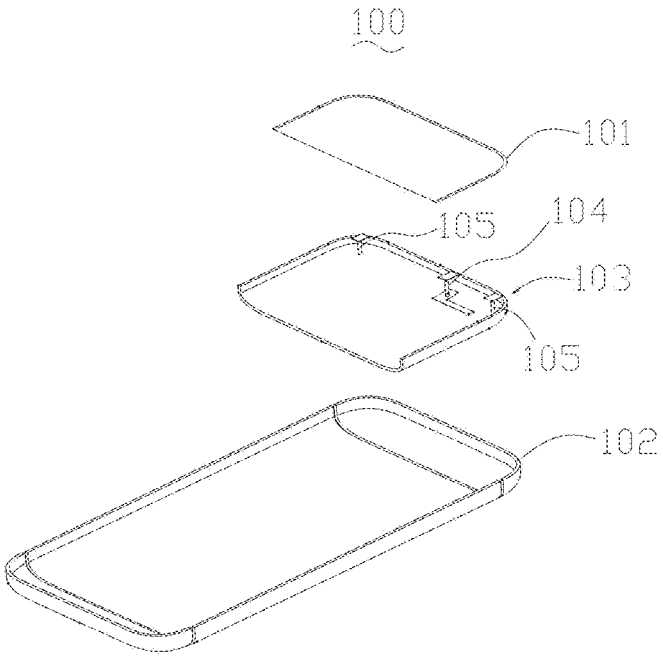
FIG. 1 is an exploded view of an antenna module according to an exemplary embodiment of the present disclosure.
Figure 2:
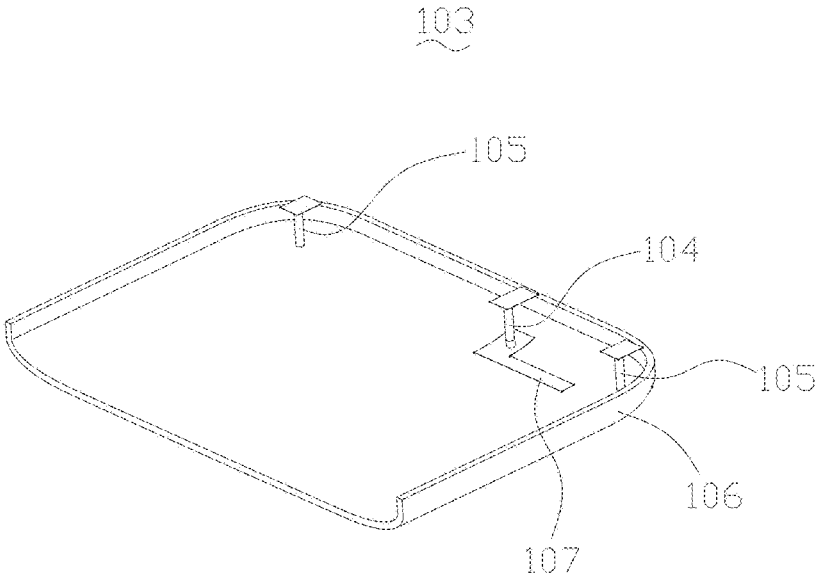
FIG. 2 is enlarged view of a capacitive coupling feed part of the antenna module in FIG. 1.
Figure 3:
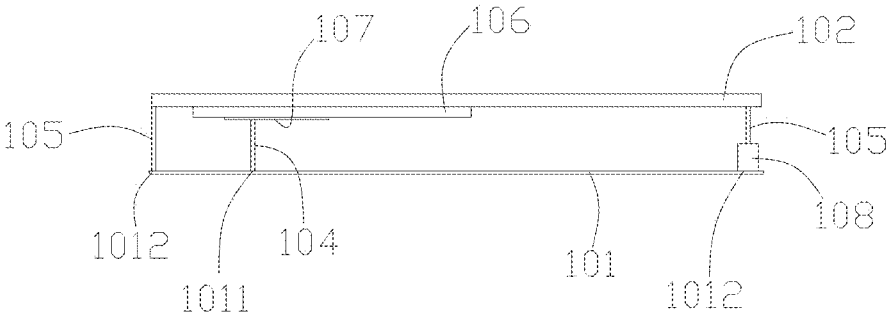
FIG. 3 is assembled view of the antenna module in FIG. 1.

Referring to FIGS. 1-3, an antenna module 100 according to an exemplary embodiment of the present disclosure is illustratively shown. The antenna module 100 is applicable to a mobile communication device, and includes a main board 101, and a metal radiator 102 opposite to and keeping apart from the main board 101. In the present embodiment, the metal radiator 102 may be either a metal back cover or a metal frame of the mobile communication device.

A feed point 1011 and at least one ground point 1012 are configured on the main board 101. In the present embodiment, a pair of ground points 1012 is disposed adjacent to two opposite edges of the main board 101. The feed point 1011 is disposed between the pair of ground points 1012. Moreover, the metal radiator 102 is connected to the pair of ground points 1012 through a pair of ground pins 105 such as metal pins respectively.

The antenna module 100 further includes a capacitive coupling feed part 103 attached to an inner surface of metal radiator 102 and facing the main board 101. The capacitive coupling feed part 103 includes a substrate 106 attached to the inner surface of the metal radiator 102, and a coupling feed unit 107 disposed on and carried by the substrate 106. The coupling feed unit 107 is connected to the feed point 1011 of the main board 101 via a connecting member 104. The substrate 106 may comprise a flexible circuit board, and the coupling feeding unit 107 may comprise a metal sheet made of metal material such as phosphor bronze or stainless steel. In addition, the connecting member 104 may comprise a metal pin or other conductive member.

The substrate 106 is insulated from the metal radiator 102, in other words, no electrical connection exists between the substrate 106 and metal radiator 102, by virtue of which, the metal radiator 102 is capacitively coupled to the capacitive coupling feed part, and is capable of receiving feed from the coupling feed unit 107 in a capacitive coupling manner.

In the antenna module 100 as provided in the present embodiment, due to the substrate 106 and the coupling feed unit 107 of the capacitive coupling feed part 103 positioned on the substrate 106, an antenna shape is variable to make the coupling feeding unit 107 have a desired configuration, which can not only improve a space unitization efficiency within the mobile communication device, but also increase available bandwidth and antenna efficiency of the antenna module 100.

Furthermore, in the present disclosure, the antenna module 100 may optionally include a dynamic adjustable matching switch 108 electrically connected between one of the ground pins 105 and a corresponding one of the ground points 1012. The dynamic adjustable matching switch 108 can be used for adjusting a low-frequency resonant frequency of the antenna module 100 and further increasing the available bandwidth of the antenna module 100.

Furthermore, a plurality of connection points may be formed in the metal radiator 102, which are discretely distributed at the edges of the metal radiator 102. The connection points are connected to a system ground, namely a ground of the main board 101, and thus can diminish noise waves and improve the performance of the antenna module 100.

It is to be understood, however, that even though numerous characteristics and advantages of the present embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An antenna module for a mobile communication device, comprising:

a main board, comprising a feed point and at least one ground point provided thereon;

a metal radiator opposite to the main board and electrically connected with the at least one ground point of the main board; and a capacitive coupling feed part attached to a surface of the metal radiator and facing the main board, and further located between the metal radiator and the main board; the capacitive coupling feed part being electrically connected to the feed point of the main board via a connecting member; wherein the capacitive coupling feed part comprises a substrate attached to the metal radiator, and a coupling feed unit disposed on the substrate; the coupling feed unit, the substrate and the metal radiator are stacked on one another in a direction away from the main board.

2. The antenna module for a mobile communication device of claim 1, wherein each of the at least one ground point is electrically connected with the metal radiator via a ground pin.

3. The antenna module for a mobile communication device of claim 2, further comprising a adjustable matching switch for adjusting a resonant frequency of the antenna module, wherein the adjustable matching switch is electrically connected between a ground point and a corresponding ground pin.

4. The antenna module for a mobile communication device of claim 1 wherein the substrate is a flexible printed circuit board (FPC), and the coupling feed unit is a metal sheet.

5. The antenna module for a mobile communication device of claim 1, wherein the substrate is insulated from the metal radiator.

6. The antenna module for a mobile communication device of claim 1, wherein the connecting member comprises a metal pin.

7. The antenna module for a mobile communication device of claim 1, wherein the metal radiator is a metal back cover or a metal frame of the mobile communication device.

8. The antenna module for a mobile communication device of claim 1, wherein the at least one ground point comprises a pair of ground points respectively adjacent to two opposite edges of the main board, and the feed point is provided between the pair of ground points.

9. The antenna module for a mobile communication device of claim 1, wherein the substrate includes a first base plate and a first side wall bent from the first base plate; the metal radiator includes a second base plate and a second side wall bent from the second base plate; the first base plate is located in a plane parallel to a plane where the coupling feed unit located, and parallel to a plane where the second base plate located.

10. An antenna module for a mobile communication device, comprising:

a main board with a feed point;

a metal radiator opposite to the main board and being grounded via the main board; and a capacitive coupling feed part attached to the metal radiator and facing the main board, and further located between the metal radiator and the main board; the capacitive coupling feed part being electrically connected to the feed point of the main board via a connecting member; wherein the metal radiator is capacitive-coupled to the capacitive coupling feed part, and is configured to receive feed from the capacitive coupling feed part in a capacitive coupling manner; wherein the capacitive coupling feed part comprises a substrate attached to the metal radiator, and a coupling feed unit disposed on the substrate; the coupling feed unit, the substrate and the metal radiator are stacked on one another in a direction away from the main board.

11. The antenna module for a mobile communication device of claim 10, wherein at least one ground point is provide on the main board, and each of the at least one ground point is electrically connected with the metal radiator via a ground pin.

12. The antenna module for a mobile communication device of claim 11, wherein the at least one ground point comprises a pair of ground points respectively adjacent to two opposite edges of the main board, and the feed point is provided between the pair of ground points.

13. The antenna module for a mobile communication device of claim 12, further comprising a adjustable matching switch for adjusting a resonant frequency of the antenna module, wherein the adjustable matching switch is electrically connected between one of the ground points and the corresponding ground pin.

14. The antenna module for a mobile communication device of claim 10, wherein the substrate is a flexible printed circuit board (FPC), and the coupling feed unit is a metal sheet.

15. The antenna module for a mobile communication device of claim 10, wherein the substrate is insulated from the metal radiator.

16. The antenna module for a mobile communication device of claim 10, wherein the connecting member is a metal pin.

17. The antenna module for a mobile communication device of claim 10, wherein the metal radiator is a metal back cover or a metal frame of the mobile communication device.

* * * * *